United States Patent [19]

Görig

[11] 4,194,440

[45] Mar. 25, 1980

[54] METHOD AND APPARATUS FOR MAKING DRUM-SHAPED CARDBOARD CONTAINERS

[76] Inventor: Rudolf Görig, Kanalstrasse 12, D-7064 Remshalden 1, Fed. Rep. of Germany

[21] Appl. No.: 875,683

[22] Filed: Feb. 6, 1978

[30] Foreign Application Priority Data

Feb. 10, 1977 [DE] Fed. Rep. of Germany ..... 2705596

[51] Int. Cl.[2] ..... B31B 17/26

[52] U.S. Cl. ..... 93/39 C; 93/39.2; 93/55.1 P

[58] Field of Search ..... 93/39.1 R, 39 C, 39.2, 93/39.3, 39.1 P, 55.1 R, 55.1 P, 44.1 R

[56] References Cited

U.S. PATENT DOCUMENTS

| | | | |
|---|---|---|---|
| 1,444,096 | 2/1923 | Beadle | 93/39.2 |
| 2,168,543 | 8/1939 | Vergobbi | 93/44.1 R |
| 2,674,929 | 4/1954 | Wittkuhns et al. | 93/39.3 X |
| 3,103,857 | 9/1963 | Geisler et al. | 93/39.2 |
| 3,958,501 | 5/1976 | Richards | 93/44.1 R X |
| 4,033,241 | 7/1977 | Roda | 93/39.1 R |
| 4,100,842 | 7/1978 | Richards et al. | 93/39 C |

*Primary Examiner*—James F. Coan

*Attorney, Agent, or Firm*—Frishauf, Holtz, Goodman & Woodward

[57] ABSTRACT

A stack of flat cardboard blanks, which may be preprinted with contents or advertising matter, and having approximately the dimensions of the developed circumference of the container, and slightly larger in circumferential direction, is positioned over a transport conveyor which peels off one blank at a time, the flat blank being transported past a gluing station to apply a strip of adhesive along a longitudinal edge of the blank parallel to the edges of the drum when the container is formed. The blank is then wrapped around a mandrel by gripping jaws. The mandrel has the general shape of the container and forms the blank into an open sleeve with overlapping edge portions of the blank which are adhered together by the adhesive previously applied. The adhesion may be done under pressure and with application of heat, for example by applying a heated stamping block thereagainst. The mandrel may also be heated. A bottom is then inserted into the then formed cylinder, for example in form of a shallow dish inserted upside-down, with the edges of the cylinder rolled thereover to space the bottom of the cylinder from the bottom plane of the so formed container. The container may be circular-cylindrical polygonal-cylindrical, for example rectangular or square in cross section, and is particularly suitable for transporting pulverized grainy or lumpy goods, such as soap powder, and the like.

21 Claims, 15 Drawing Figures

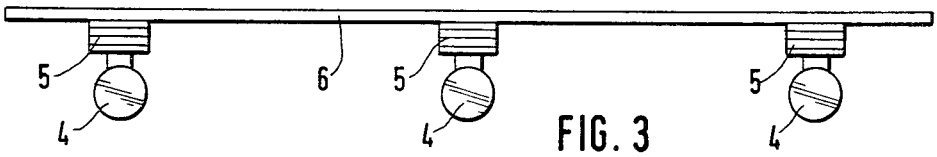
FIG. 3
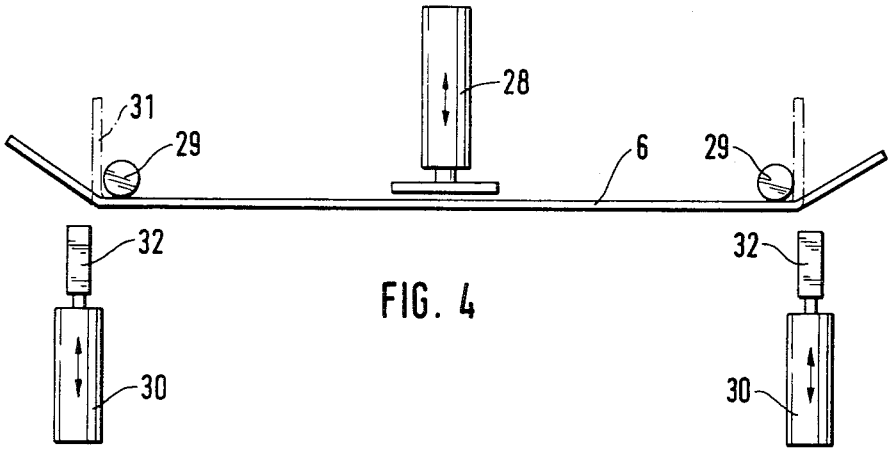
FIG. 4
FIG. 5
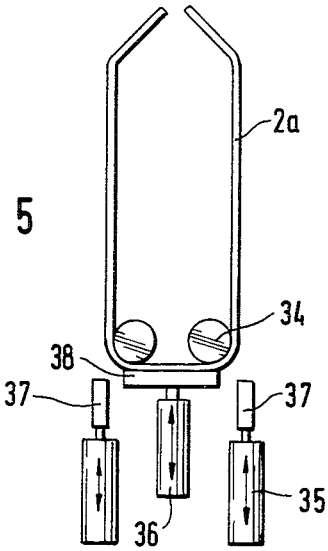

METHOD AND APPARATUS FOR MAKING DRUM-SHAPED CARDBOARD CONTAINERS

The present invention relates to the manufacture of containers, and more particularly of the drum type, especially for packaging of powdery or granular or lumpy substances such as, for example, the packaging of soap powder, detergents, or similar substances, in quantities suitable for retail supermarket distribution.

BACKGROUND AND PRIOR ART

Various types of containers are used to package powdery and granular substances, in lumpy or grainy form or the like. Most containers of this type require a fair amount of material, and difficulties arise when it is intended to reclose such containers after having once been opened subsequent to sealing thereof after filling of the containers. Folding boxes and the like are comparatively expensive to make and frequently are not self-supporting, that is, stable and strong, which permits stacking of several layers of filled boxes above each other. It has therefore been proposed to utilize containers made in drum shape constructed of cardboard. These drum-shaped containers, heretofore, were wrapped in spiral form. This is an expensive and comparatively complex manufacturing method. It is also difficult to print content identification and advertising on the containers in advance of their manufacture. The quality of printing is substantially higher if it can be carried out when the material of which the container is made lies flat, rather than after the container has been formed. It has therefore been customary to provide special labels or over-wrappers about the containers to carry printed identification, advertisements, and other information; as an alternative, special printing machines can be used to print on round or box-shaped containers which are complex and expensive. The well-known spiral wrapping method is particularly applicable for containers with circular cross section and cannot be used with containers having square or rectangular cross section. Containers have square or rectangular cross section are desirable since a greater volume of goods contained therein can be placed within a given space, and since they permit better stacking. Manufacture of cardboard containers in accordance with the spiral-wrapping method is time and labor intensive so that the eventual yield of the container manufacturing machine is low.

THE INVENTION

It is an object to provide a method of manufacturing a generally cylindrical container of cardboard which is rapid, simple, and which permits manufacture of containers of any desired cross section, for example square, rectangular or, if desired, triangular, hexagonal, or otherwise; and which permits, as desired, the use of solid cardboard or corrugated cardboard.

Briefly, a flat blank, which may be preprinted with advertising or other indicia, is removed from a stack of blanks. The blank is approximately of the size of the developed circumference of the container, but slightly larger in circumferential direction. While flat, and as it is being transported, it has an adhesive applied along at least one of the edges. It is then moved towards a mandrel and shaped to fit around the mandrel by means of shaping jaws engaging the blank. The blank, shaped and formed around the mandrel, is of such size that the adhesive-coated strip will overlap the opposite edge of the blank as it is formed around the mandrel. It is adhered thereto, for example by means of a heated stamp element pressed against the mandrel which also may be heated. The thus formed sleeve then has a preformed bottom inserted therein. The bottom is securely attached to the sleeve, for example by rolling the edge of the sleeve over a projecting edge of the bottom.

Drum-shaped containers of any desired cross-sectional shape, such as round, square, rectangular, or as desired, can readily be made at an operating speed which is high with respect to the operating speed possible in spiral-wrap machines. The requirements placed on the quality of the material for the cardboard blank is low so that cheaper materials of lesser quality can be used and worked into drum-shaped containers, if the material or goods to be filled into the container permit the use of medium and low-quality materials for the walls thereof.

The blank can be subjected to printing before being shaped, while it is flat. Any printing machine may be used therefor; such printing machines are customarily available in packaging or container plants. The strength of the adhesive seam which is formed when making the container can be increased by prebending or precreasing the blank at those points where it is to be formed around an edge of the mandrel, or adjacent the adhesive strip where a small overlap edge might form. Pre-shaping a blank, particularly when made of comparatively stiff cardboard, before application of the blank to the mandrel may be desirable. Such deformation before the actual blank forming can preferably be carried out by use of heat being applied to the cardboard blank so that the cardboard blank will deform readily without scoring cuts or interference with the integrity of the surface of the blank. The deformation can further be facilitated by heating both the mandrel as well as the application jaws which shape the blank around the mandrel, or at least one of them.

The bottom of the container preferably is inserted in an insertion station which follows the drum or cylinder-forming station of the manufacturing machine. The bottoms, preferably, are dish-shaped or flat elements having a projecting rim which can be introduced on the formed blank while it is still on the mandrel. These bottom blanks are then pushed by a pusher element or pusher rod, singly, unto the sleeve of the container still located on the mandrel. The sleeve and the container bottom are then connected together by rolling over the bottom edge of the sleeve, so that it will engage around the flange or upstanding rim formed by the bottom. The result will be a container which is very sturdy and in which the bottom is spaced from the plane of the bottom edge of the sleeve so that the bottom of the container will be clear of a support surface on which the container may be put. A rolled-over edge is a support which is of high strength and provides for stable positioning of the entire container.

DRAWINGS

Illustrating an example of a preferred embodiment:

FIGS. 3, 4 and 5 are cross section on respective lines III—III, IV—IV, and V—V, shown highly schematically, and omitting the transport device, and to a different scale to permit visualization of the relative stations along the transport path to make a drum-shaped container of rectangular cross-section;

Figure 2:
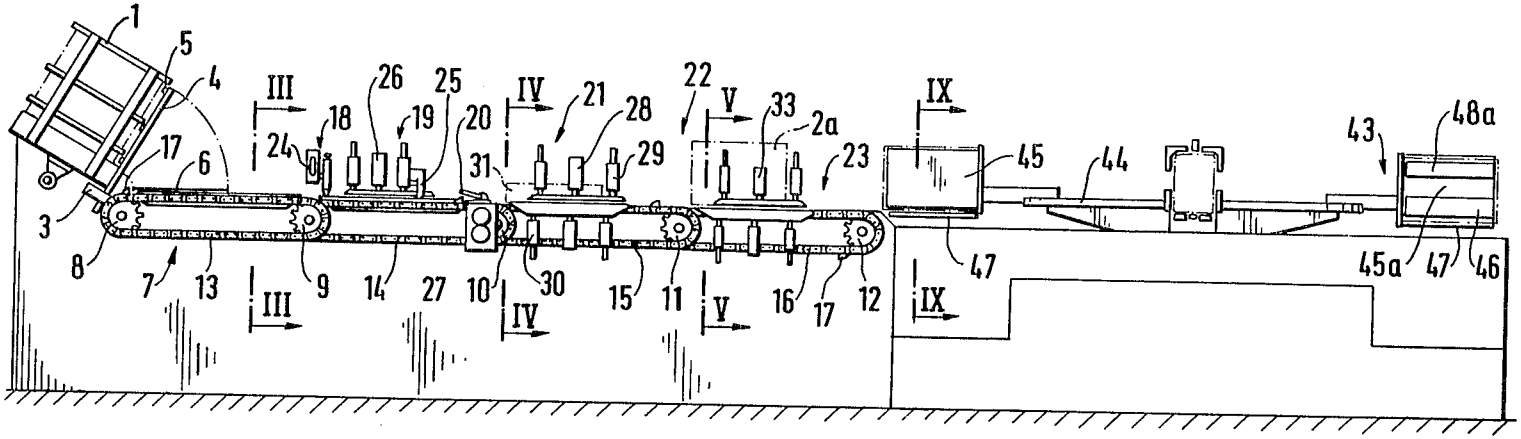
FIG. 2 is a side view of the apparatus of FIG. 1.
Figure 6:
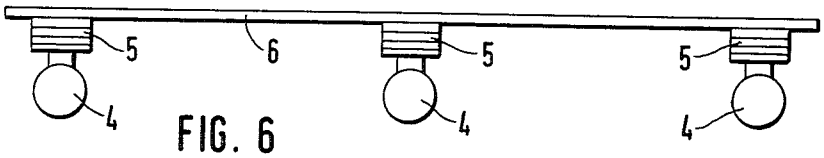
Figure 7:
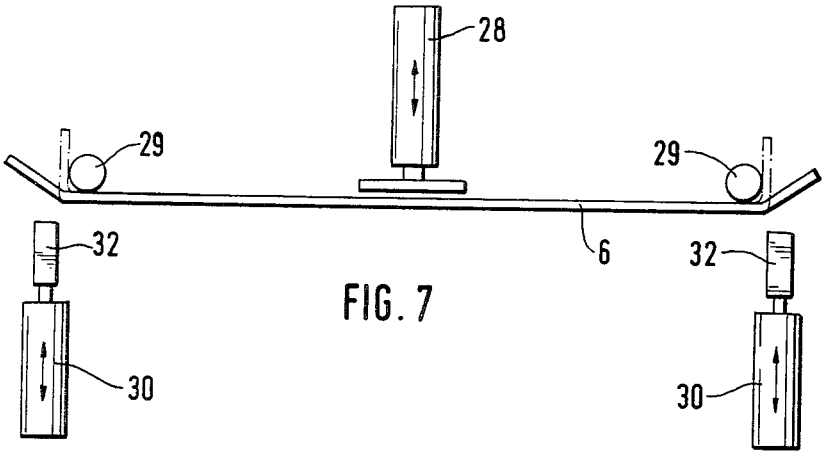
Figure 8:
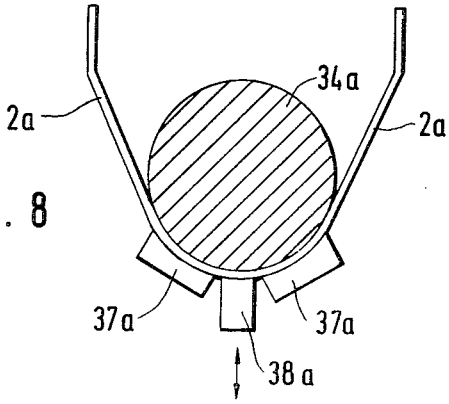
Figure 9:
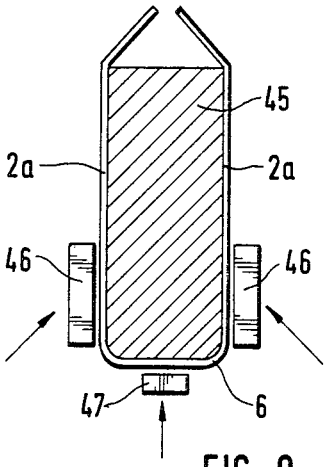
Figure 10:
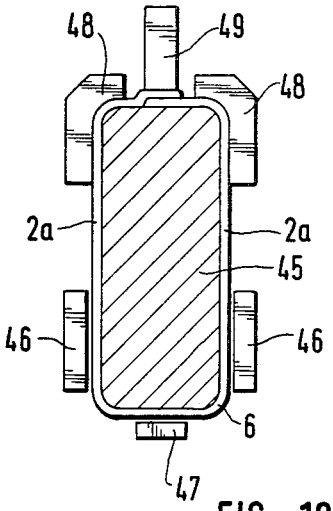
Figure 11:
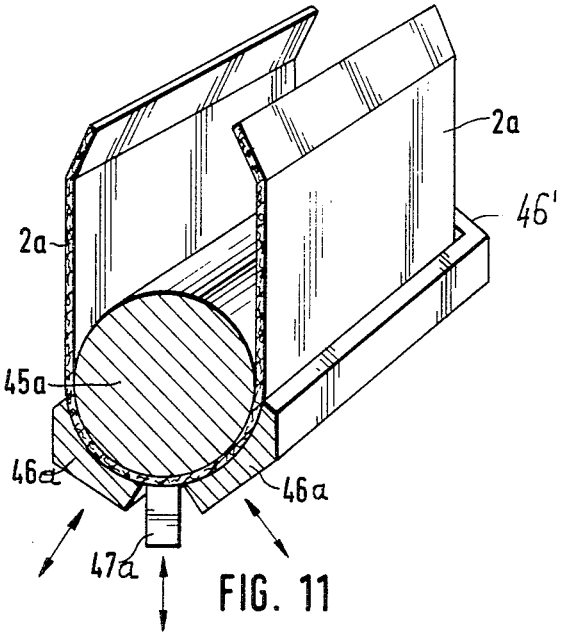
Figure 12:
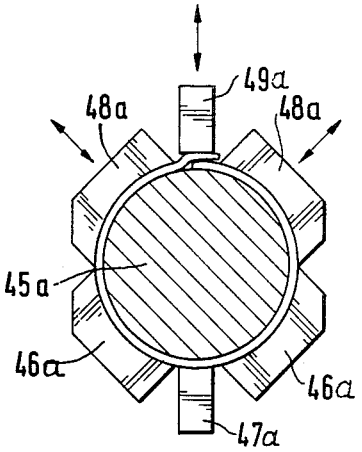
Figure 13:
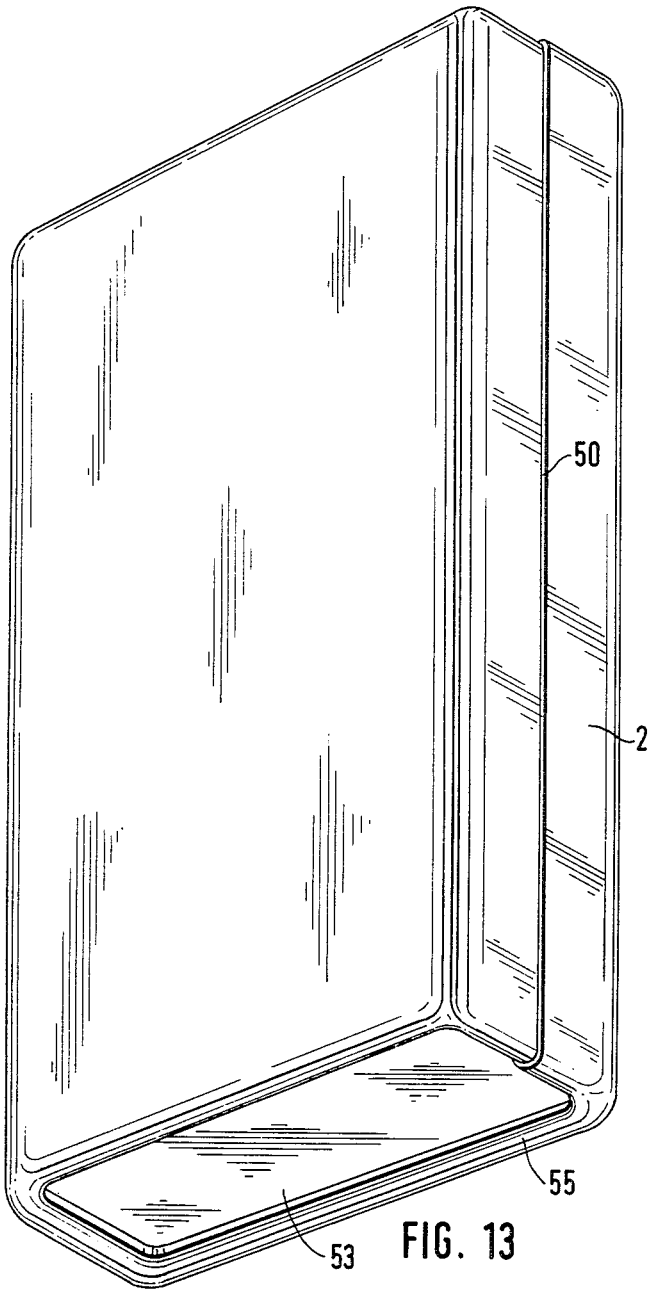
Figure 14:
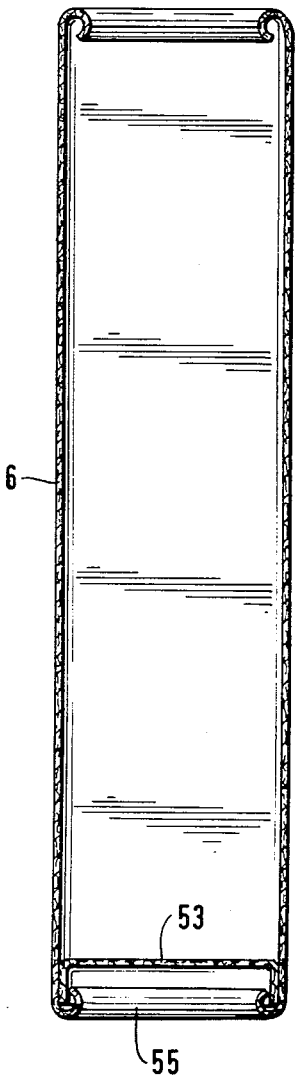
Figure 15:
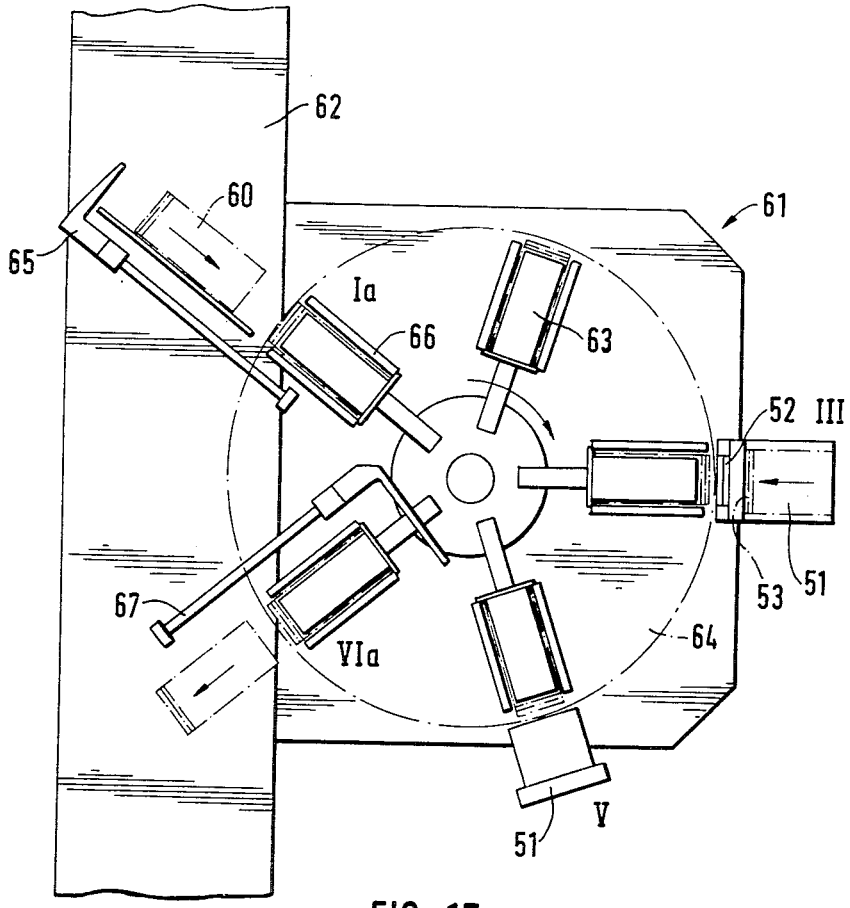

FIGS. 6 to 8 correspond to FIGS. 3 to 5 to make containers of circular cross section;

FIG. 9 is a cross section through line IX–IX of FIG. 2, in side view, shown highly schematically, and omitting the mandrel turret, to a different scale, and to make a drum-shaped container of essentially rectangular cross section;

FIG. 10 shows the arrangement of FIG. 9 in the pressing station;

FIGS. 11 and 12 show the arrangements in accordance with FIGS. 9 and 10 applied to a container with circular cross section;

FIG. 13 is a perspective view of a drum-shaped container, seen from the bottom, with rectangular cross section;

FIG. 14 is a fragmentary side view of the container of FIG. 13, in cross section; and FIG. 15 is a top view of a bottom insertion station.

Figure 1:
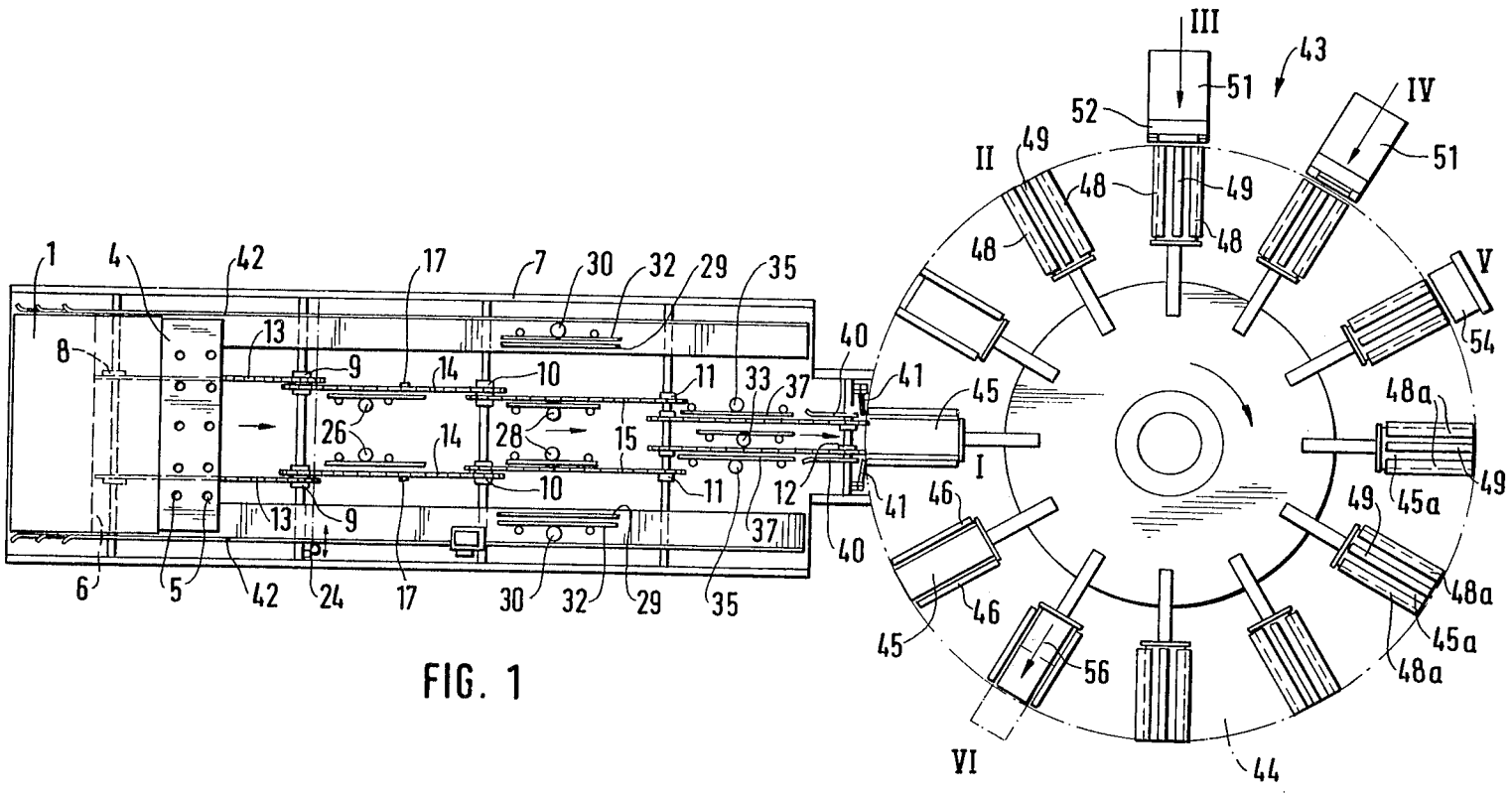
FIG. 1 is a highly schematic top view of an apparatus to make drum-shaped containers.

Referring first to FIGS. 1 and 2: A stack of cardboard blanks, which may be preprinted with advertising or content indicia, is held in a stacking magazine 1 (FIG. 2). The blanks correspond approximately to the developed surface of the container 2 (FIG. 13) which is eventually to be formed. The cardboard may be solid cardboard material, corrugated material, or similar packaging-grade cardboard material. The magazine 1 is associated with a transfer arm 4 which is pivoted at a pivot point 3. Transport arm 4 grips the lowermost blank 6 in the stack to transfer the blank to a conveyor system 7. The conveyor system or apparatus 7 has four longitudinally arranged and staggered chain conveyors having transport chains 13, 14, 15, 16 which are looped, respectively, over respective looping rollers or looping drums 8, 9, 10, 11, 12. The transport chains 13–16 have spaced pick-up stubs 17 located thereon which engage the edge of a blank 6 and transport the blank along a transport path which, in FIG. 2, extends from the left towards the right. The pick-up stubs 17 of the respective subsequent transport chains 13, 14, 15, 16 are so offset with respect to each other that transfer of a blank 6 from one transport chain to the next provides for a short interval during which the blank is not transported but, rather, is stopped so that it can be acted on and treated or worked on in respective stations, as will appear, when it is stationary.

The transport path defined by the transport system 7 carries the blanks 6 singularly, one after the other, to sequentially located working stations, of which the first is a gluing or adhesive application station 18; the next an alignment station 19, a second adhesive application station 20, two preforming stations 21, 22, and then to a transfer station 23. The respective cardboard blanks 6 are sequentially carried through this transport path to the stations 18–23, the cardboard blanks remaining stationary for short periods of time, as required in at least some of those stations.

The cardboard blanks 6 are sequentially moved by the transport arm 4 to the first transport chains 13 and are carried therealong by the stubs 17 to the first adhesive application station 18. The blanks 6 are accurately aligned by alignment elements 25 in the alignment station 19 and are then held down for a short interval by a holder 26. A glue applicator 24, which is movable transverse to the transport path, and which is located at the rear edge of the respective blank 6, then applies an adhesive or glue to the blank 6. This strip of adhesive, later on, will be used to secure the bottom into the container.

As soon as the conveyor or transport stubs 17 of the next transport chain system 14 engage the blank 6 which, now, has adhesive applied thereto to secure the bottom therein, the holder 26 is moved upwardly, releasing the blank for transport by the chains 14 and to carry the blank through a second glue or adhesive application station 20. The second glue station 20 has a glue applicator 27 which applies a strip of glue to the lower edge of the blank 6. This strip will then form the sleeve seam for the finished container. An additional adhesive application arrangement similar to arrangement 27 can be located at the other side of the blank 6 so that, eventually, two adhesively coated strips of the container will be caused to be overlapped, thus providing an even stronger bond, if such is necessary.

The stubs 17 of the chains 14 then transfer the blank 6 into a preforming station 21. Preforming station 21 again includes a holder 28 to hold the blank stationary and in position during preforming, which will be carried out in a very short time interval. The preforming station 21 has movable counter elements 29 (see also FIGS. 4, 7) which engage the blank 6 at the upper side thereof. Associated preforming stamp or punch elements 30 (FIGS. 4, 7) with shaping or forming jaws 32 attached thereto, are movable upwardly so that the lateral end portions 31 (FIG. 4) of the blank are bent upwardly by about 90°, thus providing for precreasing or preforming the lateral edges adjacent the region which, later on, will form the seam line. The counter holders 29 are essentially cylindrical and, preferably, are heated in order to facilitate preshaping or precreasing the blank 6. The forming jaws 32 are moved, for example, by a mechanical, pneumatic, hydraulic, or electrical lift drive counter the counter holders 29 (see FIGS. 4–7). Jaws 32 also may be heated.

After release of the holder 28, the preformed, or precreased blank 6 can then be transferred by the transport chains 16 to the second preforming station in form of a creasing station 22 in which the blank 6 is again held stationary, for a short period of time, by a holder 32. The second preforming or precreasing station 22 shapes the blank 6 to have an essentially U-shaped shape, when looked at from the top, or in cross section. The container, at this point, will be shaped to approach the final shape it is to have. If the container is to have rectangular cross section (FIGS. 13, 14), then the second precreasing station 22 will include two cylindrical counter holders 34 (FIG. 5) associated with forming jaws 37 located at the other side of the blank, and movable by suitable mechanical, hydraulic, pneumatic, or electrical longitudinally moving mechanisms 35 which, collectively, can be referred to as shaping punches. A counter holder 36, likewise reciprocable similar to jaws 37, is located between the jaws 37 (see FIG. 5) to hold the blank in position against the counter holders 34. A clamping plate 38 securely presses the blank against the counter holders 34. Upon reciprocating upward movement of the jaws 37, the side portions **2*a* of the blank are folded upwardly, as seen in FIG. 5**.

If the container is to have essentially cylindrical cross section, then the second deformation is carried out as illustrated in FIG. 8. A heated single counter element **34*a* is provided. The system 35 terminates in jaws 37*a*, 37*c* which have generally circular internal shape, that is, have a part-cylindrical engagement surface to form the side walls 2*a*** of the container around the counter holder 34*a*. The center holder 38 is located between the jaws 37*a*, 37*c* to hold the blank securely in position against the counter holder 34*a*. Preferably, the counter holder 34*a* is heated; it may be partly hollow, and heated by steam, or can be heated electrically or otherwise. As seen in FIG. 8, the side walls 2*a* of the container are pre-bent so that the blank will, again, have essentially U-shape.

After release of the holders 36, 38, 38*a*, respectively, and release of the holder 32, which may engage the counter elements 34, 34*a*, respectively, the then pre-shaped or preformed blank 6 is transferred at the end of the transport system 27 to a transfer station 23 in which two lateral guide walls formed, for example, of sheet metal 40, are located. The guide walls 40 define a guide channel through which the U-shaped preformed cardboard blank 6 is pushed while maintaining the shape which the cardboard blank had received. The walls 40 thus prevent resilient flattening of the cardboad blank. Two alignment elements 41 (FIG. 1) are associated with the guide sheets 40 which are so located and positioned that they arrange the respectively opposite walls of the preformed, pre-cut blank 6 such that the lateral edges will later on match when wrapped around a mandrel, so that the adhesion will result in a seam in which the lateral edges or ends of the overlap are flush with respect to each other.

The transport system additionally includes lateral guide elements 42, for example in the form of guide strips or sheet metal strips, to guide the blank 6 through the various stations while the blank is still flat.

The actual sleeve-shaped form is given to the blank in a sleeve forming apparatus 43 (FIGS. 1, 2) which, in a preferred form, is arranged in a turret rotatable about a vertical axis. A turret base or turret wheel 44 is driven from a suitable preferably intermittent drive (not shown). The turret wheel 44 carries spaced mandrels 45 which have a cross-sectional shape corresponding to the internal shape and dimensions of the finished container. Thus, for manufacture of containers 2 (FIG. 13), the mandrels are of essentially rectangular cross section—see FIGS. 9 and 10; to manufacture drum-shaped containers with circular cross section, the mandrels 45*a* will be essentially cylindrical—see FIGS. 11, 12. Containers of more than one cross section can be made on the same machine if the turret wheel has mandrels of respectively different shapes located thereon and, for example, the preforming station has both counter elements 34 and 34*a* as well suitably matched jaws 37 and 37*a*, 37*c*. Which jaws engage at what time can readily be controlled by a suitable sequencing control, as well known and available as commercial control articles. FIG. 1 illustrates a turret wheel 44 with two mandrels 45*a* of circular cross section, and additionally mandrels 45 of rectangular cross section. The respective mandrels 45, 45*a* are associated with forming jaws 46 (FIGS. 9, 10), 46*a* (FIGS. 11, 12). The forming jaws 46, 46*a* are located on the turret wheel 44 and so arranged with respect to the associated mandrel that a small space will remain between the forming jaw and the mandrel, just enough to receive the side walls of the U-shaped preformed blank 6. The transfer station 23 is so arranged that a preformed U-shaped blank 6 can be pushed on the respective mandrel 45, 45*a* from the duct or channel defined by the guide walls 40. The turret wheel 44 then continues to rotate, carrying with it the mandrel 45, 45*a*, respectively, with the cardboard blank located thereon. The position of the transfer station is indicated at I in FIG. 1. A holder or clamping plate 47 (FIGS. 9, 10), 47*a* (FIGS. 11, 12) holds the preformed blank against the mandrel 45, 45*a*, assisting the holding operation of the jaws 46, 46*a*. The blank is thus securely held against the mandrel and pressed thereagainst during movement of the blank from station I further on along the forming path of the turret wheel 44. FIGS. 9 and 11 illustrate the placement of the preformed blank on the mandrel and clamping of the blank against the mandrel.

As the turret wheel continues to rotate, the respective mandrel 45, 45*a* reaches the forming and pressing station II in which two further forming jaws 48, 48*a* are moved in engagement with the respective blank to form the blank around the mandrel. After the blank has been formed around the mandrel, a compression clamp or punch 49, 49*a* is moved against the seam line. The seam line is formed where the blank has been precoated with adhesive, and the compression element 49 preferably extends over the full length of the seam line, that is, over the full length of the container to be formed. The holding jaws 46, 46*a* as well as the forming jaws 48, 48*a* and the seam forming plunger element 49 are all held for reciprocating movement, and moved in reciprocation, for example by hydraulic, pneumatic, electrical or mechanical elements. The stamp 49, 49*a* is movable between the respective forming jaws 48, 48*a* to reciprocate to and fro and form the longitudinal seam in which the overlapping previously adhesive-coated edge portions of the cardboard blank 6 are adhered together. The element 49 can be heated; to further facilitate the final shaping and forming of the cylinder, the pressing station can be equipped with supersonic or infrared devices which assist instantly, or for a short time heating the adhesive material and rendering it strongly adhesive. The adhesive strip need not be applied in form of a continuous strip; it is also possible, for example, to apply a plurality of adhesive dots, preferably in laterally offset rows, to form a continuous adhesive seam; or to apply adhesive in dots which, upon compression under force of the stamping element 49, flow together. The mandrel as well as the jaws can also be heated.

The longitudinal seam 50 formed in the sleeve (FIG. 13) thus shapes the original flat cardboard blank 6 into an open sleeve.

To make a complete container, it is necessary to insert a bottom thereinto. In accordance with a feature of the invention, this bottom is inserted in bottom insertion stations III or IV (FIG. 1); the bottom can also be inserted in a separate apparatus which, essentially, includes the components of the stations III, IV, if space for installation, production capacity, etc. makes this desirable. Referring to FIG. 1, a push element 51 is positioned for reciprocating movement with respect to the mandrel 45, 45*a*, respectively. Preshaped bottom elements are supplied to the reciprocating element 51 which, preferably, is in form of a piston, through a supply conveyor 52, not further shown in detail. The bottom 53 is a horizontal disk-like element with a flange extending at approximately 90° with respect thereto, inserted into the open sleeve previously formed of the blank 6. The piston 51 pushes this pot or cup-shaped bottom 53 into the open sleeve upon movement to station IV; alternatively, the functions of stations III and IV can be combined. A further subsequent rolling station then forms a rolled bottom by rolling over the bottom edge of the tube as seen at 55 (FIGS. 13, 14). In the rolling station V, the end portion of the sleeve is rolled over, as shown; alternatively, the flange, adhering to the previously adhesive-coated edge of the sleeve, can be rolled over together with the edge portion of the sleeve.

Insertion of the bottom into the sleeve requires more time than the formation of the longitudinal seam and thus FIGS. 1 and 2 show two bottom insertion stations III, IV which, together, can effect insertion of the bottom at the same time as the formation of the sleeve. These stations may move with the turret wheel 44.

The finished drum-shaped container 2, with the desired cross section, is ejected from the mandrel 45, 45*a*, respectively, at an ejection station VI by a suitable pusher 56.

The turret wheel 44 can be so arranged that a plurality of adjacently located stations are associated therewith which, thus, can operate at the required time interval to permit the proper time lapse for adhesion of the adhesive of the seam of the sleeve and, if necessary, of the bottom to the sleeve as well as of the rolling-over of the bottom in synchronism with feed of the preformed blanks. The mandrels can be arranged in various ways with respect to the receiving station 43; a turret is a simple and efficient arrangement which is, additionally, space-saving. It is also possible to mount the mandrels on different forms of conveyors or movable elements, for example on a transport chain or the like which is guided over suitable rollers in a transport path, the respective mandrels being located on the transport conveyor and passing the various stations I through VI.

The lateral jaws 46, 46*a* are formed with elements 46' which ensure that the blank 6 is properly located on the mandrel 45, 45*a* with the edges properly aligned before it is finally shaped and adhered. The edge portions 46, 46*a* are positioned with respect to the mandrel 45, 45*a* with sufficient clearance to permit insertion of the preformed blank around the mandrel before movement of the jaws against the respective mandrel.

In another embodiment, the arrangement can be so made that the turret wheel 44 is used only to finish the seam 50 in the pressing station III and then transfers the sleeve directly into the ejection station VI. The turret wheel 44 then will have a separate bottom insertion apparatus. Referring to FIG. 15: A conveyor 62 provides the open sleeves, received from the ejection station VI, to a bottom insertion apparatus 61. The sleeves 60, received from the ejection station VI, are pushed on a receiving mandrel 63. Receiving mandrels 63 include an endless chain 64 or a suitable turret wheel, or other similar endless conveyor on which the receiving mandrels 63 are radially located. The sleeves 60 are pushed on the respective mandrel by a reciprocating pusher 65, operating at a station I*a*. Clamping jaws, similar to the jaws 37 (FIG. 5), 37*a*, 37*c* (FIG. 8), 46, 48 or 46*a*, 48*a* (FIGS. 9–12) hold the sleeve in position. A bottom insertion station III and a rolling station V, similar to the respective stations illustrated in FIG. 1, then insert a pot or cup-shaped bottom as previously described. The finished container is ejected at an ejection station IV*a* by a pusher 67 and transferred again to the conveyor 62. The various elements of the sleeve forming device 43 and of the bottom insertion apparatus 61 can be controlled by well-known sequencing control systems, preferably by a cam mechanism.

The turret wheel 44, or any other conveyor arrangement such as, for example, an endless chain, can be arranged in either horizontal or vertical plane as desired, and in accordance with design criteria, principally governed by cost and space considerations.

Various changes and modifications may be made within the scope of the inventive concept.

I claim:

1. Method of making a cardboard container of circular or polygonal, generally cylindrical form, open at one end, comprising, in accordance with the invention, the steps of providing a flat, essentially rectangular blank (6) having one dimension of approximately the height of the container and another dimension slightly longer than the developed circumference of the container;

applying a strip of adhesive along a longitudinal edge of the blank parallel to the axis of the cylinder when the container is formed;

preforming the blank to have generally U-shaped cross section in advance of the step of wrapping the blank around a mandrel (45, 45*a*);

wrapping the blank around the mandrel (45, 45*a*) of the general shape of the container to form an open sleeve;

overlapping edge portions of the blank to form an axially extending seam line;

adhering the adhesive strip along the sleeve surface at the overlapping portions to form an adhesive seam (50);

providing a preformed bottom (53) of at least approximately the cross-sectional shape of the tube;

introducing the preformed bottom into the open sleeve spaced by a small distance from the bottom edge of the sleeve;

and securing the preformed bottom in the sleeve.

2. Method according to claim 1, including the step of preprinting the blank when it is still flat prior to applying a strip of adhesive along the longitudinal edge of the blank.

3. Method according to claim 1, wherein the step of preforming the blank (6) is carried out after applying said strip of adhesive in the vicinity of the longitudinal edges where said strip is to be applied to deform the blank at said region.

4. Method according to claim 1, including the step of precreasing the blank to form at least one break line therein.

5. Method according to claim 1, wherein said preforming step is carried out under application of heat on the cardboard blank.

6. Method according to claim 1, wherein the step of wrapping the blank around the mandrel (45, 45*a*) is carried out under application of heat, including the step of heating at least the mandrel.

7. Method according to claim 1, wherein the step of securing the bottom includes providing a preformed bottom having an axially extending flange;

and the step of securing the preformed body in the sleeve comprises rolling over the end portion of the sleeve radially inwardly over the flange of the bottom to space the bottom from the end edge of the sleeve.

8. Apparatus to make a cardboard container of circular or polygonal, generally cylindrical, form open at one end from essentially flat, essentially rectangular cardboard blanks (6) having one dimension of approximately the height of the container, and another dimension slightly longer than the developed circumference of the container;

comprising, in accordance with the invention, means (1) stacking said cardboard blanks (6) in flat form;

transport means (4, 7) removing single cardboard blanks (6) from the stacking means and transporting the blanks, flat, in a transport path;

adhesive application means (20) located along said transport path and applying a strip of adhesive to the cardboard blanks along a longitudinal edge of the blanks parallel to the axis of the cylinder when the container is formed;

a preforming station (22) including a holding element (34, 34*a*) engageable with the blank, and a reciprocating preforming jaw apparatus (35, 37), having jaws reciprocable with respect to the blank and moving with respect to the blank in a direction to bend the blank and preform the blank into at least partially the final shape it is to assume as a container and form the blank into essentially generally U-shaped cross section;

counter holder means (34) engageable with the blank at the side thereof opposite said preforming jaws to hold the blank in position to accept said generally U-shaped cross section;

a sleeve shaping station (43) located along the transport path downstream from the adhesive application means (20) including a plurality of mandrels (45, 45*a*), a movable support means (44) securing said mandrels and moving said mandrels, in sequence, in a closed path to sequentially receive, each, a blank, gripper and forming jaws (46, 48; 46*a*, 48*a*) moving with the movable support means (44) and associated with respective mandrels and moving therewith, and further being movable laterally with respect thereto to form blanks transported adjacent the mandrel around the mandrel upon lateral movement of the forming jaws towards the mandrel and overlapping edge portions of the blank to form an axially open sleeve around the mandrel, and adhesion and pressing means having a pressing stamp (49) laterally movable with respect to the mandrel engageable with the overlapping portion of the formed sleeve to adhere the strip of adhesive to the overlapping portion of cardboard, said pressing stamp being reciprocatingly movable with respect to the mandrel.

9. Apparatus according to claim 8, wherein the adhesion and pressing means is heated.

10. Apparatus according to claim 8, wherein the mandrels (45, 45*a*) are heated.

11. Apparatus according to claim 8, further including a bottom insertion station located downstream of the sleeve shaping station and including means (52) supplying preformed bottom blanks (53);

a reciprocating piston (51) positioned opposite the mandrels having open sleeves placed thereon and receiving said bottom blanks and moving said bottom blanks into and inserting said blanks into the open ends of said sleeves upon reciprocating motion of said pistons (51).

12. Apparatus according to claim 11, further including a rolling station (54) rolling over the end portion adjacent the bottom of the sleeve and located downstream of the bottom insertion portion to roll over the end edge of the sleeve with the bottom inserted therein.

13. Apparatus according to claim 8, further including an ejection station (VI) removing the sleeves from the mandrel.

14. Apparatus according to claim 13, further including a bottom insertion station located downstream of the ejection station, said bottom insertion station including a holder (63) adapted to receive a sleeve and securing said sleeve in an axially predetermined position;

a reciprocating piston (51) and means supplying a preformed bottom to the reciprocating piston, the reciprocating piston being located adjacent the holder means and pushing the preformed bottom a slight distance inwardly of the open sleeve on the holder.

15. Apparatus according to claim 8, wherein said movable support means for said mandrels (45, 45*a*) comprises a turret.

16. Apparatus according to claim 8, wherein said transport means (7) comprises at least one endless chain, and gripper stubs engageable with a blank (6) to move said blank in said transport path.

17. Apparatus according to claim 16, wherein said transport means comprises a plurality of sequentially located transport chains or belts;

said apparatus including a plurality of operating stations (18, 19, 20, 21, 22, 23) located along said transport path;

and wherein each of the points of transfer from one chain or belt to a succeeding chain or belt is located in the vicinity of the respective stations, the gripper means for said blanks on the respective chains or belts being longitudinally offset with respect to each other to provide for interruption of transport movement of the blanks while a a blank is at a respective station to permit operation on the blank at the respective station while the blank is stationary.

18. Apparatus according to claim 8, wherein the preforming station (22) is located between the adhesive application means (20) and said sleeve-shaping station.

19. Apparatus according to claim 8, further including a precreasing station (21) having a counter holder (29) engageable with one side of the blank and movable preforming jaws engageable with the other side of the blank, the counter holder and the blank cooperating and being positioned with respect to the blank to precrease or pre-break the blank at edges which will be adjacent the strip of adhesive which will form a seam line in the finished container.

20. Apparatus according to claim 8, further including preforming means (29, 30; 34, 35, 37) including a counter element engageable with one side of the blank and reciprocable forming jaws engageable with the other side of the blank;

wherein at least one of said counter elements or preforming jaws are heated.

21. Apparatus according to claim 8, further including an additional adhesion application means (18) located along said transport path and applying a strip of adhesive transversely to the direction of movement of the strip along said path to provide adhesive to the edge of the blank at a position which will be adjacent the bottom of the container when the container is formed.

* * * * *